US009065209B2

(12) United States Patent
Dinh

(10) Patent No.: US 9,065,209 B2
(45) Date of Patent: Jun. 23, 2015

(54) HERMAPHRODITIC ELECTRICAL CONNECTOR FOR TERMINATING ELECTRICAL CONDUCTORS

(71) Applicant: Thomas & Betts International, Inc., Wilmington, DE (US)

(72) Inventor: Cong Thanh Dinh, Collierville, TN (US)

(73) Assignee: Thomas & Betts International, LLC, Wilmington, DE (US)

( * ) Notice: Subject to any disclaimer, the term of this patent is extended or adjusted under 35 U.S.C. 154(b) by 28 days.

(21) Appl. No.: 13/781,820

(22) Filed: Mar. 1, 2013

(65) Prior Publication Data

US 2014/0087603 A1 Mar. 27, 2014

Related U.S. Application Data

(60) Provisional application No. 61/703,899, filed on Sep. 21, 2012.

(51) Int. Cl.

| | |
|---|---|
| ***H01R 11/11*** | (2006.01) |
| ***H01R 13/627*** | (2006.01) |
| ***H01R 13/28*** | (2006.01) |
| *H01R 4/18* | (2006.01) |

(52) U.S. Cl.

CPC ..... *H01R 13/6277* (2013.01); *H01R 4/184* (2013.01); *H01R 13/28* (2013.01)

(58) Field of Classification Search

CPC ..... H01R 11/12; H01R 23/688
USPC ..... 439/883, 889, 108, 287, 288
See application file for complete search history.

(56) References Cited

U.S. PATENT DOCUMENTS

| | | | | |
|---|---|---|---|---|
| 1,159,567 | A | | 11/1915 | Burton |
| 2,690,542 | A | | 9/1954 | Pearce et al. |
| 2,792,444 | A | | 5/1957 | Bergan |
| 3,129,993 | A | | 4/1964 | Ross |
| 3,245,028 | A | | 4/1966 | Badger |
| 3,252,124 | A | | 5/1966 | Hansen |
| 3,954,319 | A | | 5/1976 | Haines |
| 4,146,288 | A | | 3/1979 | Ramsay et al. |
| 4,481,946 | A | | 11/1984 | Altshuler et al. |
| 4,595,251 | A | | 6/1986 | Moulin |
| 5,118,303 | A | | 6/1992 | LeBaron et al. |
| 5,259,782 | A | | 11/1993 | Giffin |
| 5,593,311 | A | | 1/1997 | Lybrand |
| 5,759,055 | A | * | 6/1998 | Colantuano et al. ..... 439/287 |
| 5,857,867 | A | | 1/1999 | Henry |

(Continued)

FOREIGN PATENT DOCUMENTS

| | | |
|---|---|---|
| CA | 107830 | 10/2005 |
| EP | 0 114 230 B1 | 11/1986 |
| EP | 0 887 895 A1 | 12/1998 |

*Primary Examiner* — Phuongchi T Nguyen
(74) *Attorney, Agent, or Firm* — Hoffmann & Baron, LLP

(57) ABSTRACT

An electrical connector provides for terminating an electrical conductor. The connector includes an elongate connector body having an elongate barrel portion for accommodating one end of an electrical conductor. A transition portion extends from the barrel portion. A connection portion extends from the transition portion. The connection portion has an elongate aperture therethrough and an extending projection adjacent the aperture. The projection of one connector body is insertable into the aperture of another identically formed connector body so as to place the one connector body in electrical engagement with the other connector body.

17 Claims, 4 Drawing Sheets

(56) References Cited

U.S. PATENT DOCUMENTS

| | | | | |
|---|---|---|---|---|
| 6,302,617 | B1 | 10/2001 | Rumpp | |
| 6,447,319 | B1 | 9/2002 | Bodin | |
| 6,802,746 | B2 | 10/2004 | Carranza | |
| 6,881,084 | B2 | 4/2005 | Crossan et al. | |
| 6,921,283 | B2 | 7/2005 | Zahlit et al. | |
| 6,989,666 | B2 | 1/2006 | Kawase | |
| 7,029,303 | B2 | 4/2006 | Bordeau et al. | |
| 7,081,027 | B2 | 7/2006 | Woodward | |
| 7,137,833 | B2 | 11/2006 | Woodward | |
| 7,140,928 | B1 | 11/2006 | Jacques et al. | |
| 7,175,488 | B2 * | 2/2007 | Pavlovic et al. | 439/858 |
| 7,387,521 | B1 | 6/2008 | Weber | |
| 7,448,873 | B2 | 11/2008 | Weber | |
| 7,549,883 | B2 | 6/2009 | Hillis et al. | |
| 7,722,374 | B2 | 5/2010 | Hillis et al. | |
| 8,079,863 | B2 | 12/2011 | Wason | |
| 8,105,121 | B2 | 1/2012 | Miyamoto et al. | |
| 2002/0051345 | A1 * | 5/2002 | Serizawa et al. | 361/749 |
| 2004/0040734 | A1 * | 3/2004 | Fujii et al. | 174/84 C |
| 2007/0274073 | A1 | 11/2007 | Prineppi | |

* cited by examiner

HERMAPHRODITIC ELECTRICAL CONNECTOR FOR TERMINATING ELECTRICAL CONDUCTORS

CROSS REFERENCE TO RELATED APPLICATIONS

This application claims priority to U.S. Provisional Patent Application No. 61/703,899 filed on Sep. 21, 2012, the contents of which is incorporated herein by reference in its entirety.

FIELD OF THE INVENTION

The present invention relates generally to an electrical connector for terminating an electrical conductor. More particularly, the present invention relates to a hermaphroditic electrical connector which can be connected to an identically formed connector to place two conductors in electrical connection.

BACKGROUND OF THE INVENTION

Various techniques are used to electrically interconnect two electrical components.

Particularly in the field of motor connections, "pigtails" or short lengths of wire or conductor are employed. These pigtails are connected at one end to a motor. The other end may be electrically coupled to effect connection between pigtails. One technique for effecting such connection between pigtails is to strip the ends of the wires and twist the stripped ends together placing them in electrical connection and then subsequently placing the twisted conductor ends in a gel-filled container. Such a technique is shown and described in commonly assigned U.S. Pat. No. 2,792,444.

A more convenient technique for connecting such motor pigtails is to terminate the stripped ends with interconnectable electrical connectors which allow disconnectable connection. The coupled connectors can then also be placed in a gel-filled container protecting the connection. Disconnectable connectors of this type are shown in commonly assigned U.S. Pat. Nos. 7,137,833 and 7,081,027.

SUMMARY OF THE INVENTION

The present invention provides an electrical connector for terminating an electrical conductor comprising an elongate connector body. The connector body includes an elongate barrel portion for accommodating one end of the electrical conductor. A transition portion extends from the barrel portion. A connection portion extends from the transition portion. The connection portion has an elongate aperture therethrough and an extending projection adjacent the aperture. The projection of one connector body is insertable into the aperture of an another identically formed connector body so as to place the one connector body in electrical engagement with the other connector body.

In addition, the connector may include a tab extending in a first direction from the connector body and a hook extending from the connector body in a second direction opposite the first direction. The hook defines an open ended slot. The tab of the one connector body is insertable into the slot of the other connector body upon mutual engagement. The tab includes a cam surface for providing spring biased insertion into said slot.

In one embodiment, the connector body is integrally formed.

In another embodiment, an insert is provided which is attachable to the connection portion. The insert includes the tab and the hook. In such an embodiment, the connector body is formed from a first electrically conductive material and the insert is formed from a second electrically conductive material different from the first.

The present invention further provides a hermaphroditic electrical connection assembly for connecting a pair of electrical conductors. The assembly includes a first elongate connector body having a conductor terminating portion at one end and a connection portion at the other end. A second elongate connector body has a conductor termination portion at one end and a connection portion at the other end. The first and second connector bodies are identically formed. Each connector body includes an extending projection and an elongate aperture. The projection of each of said first and second connector bodies is insertable into the aperture of the other first and second connector bodies so as to electrically couple the first and second connector bodies.

DETAILED DESCRIPTION OF THE PREFERRED EMBODIMENT

The present invention provides a hermaphroditic electrical connector which may be used to terminate a stripped end of an electrical wire or conductor, more particularly, a pigtail conductor. The connector of the present invention allows connection of two identically formed connectors such that separately formed male and female connectors need not be employed. By employing an identical electrical connector to terminate and interconnect two wires, efficiencies in both manufacturing and inventory can be achieved.

Figure 1:
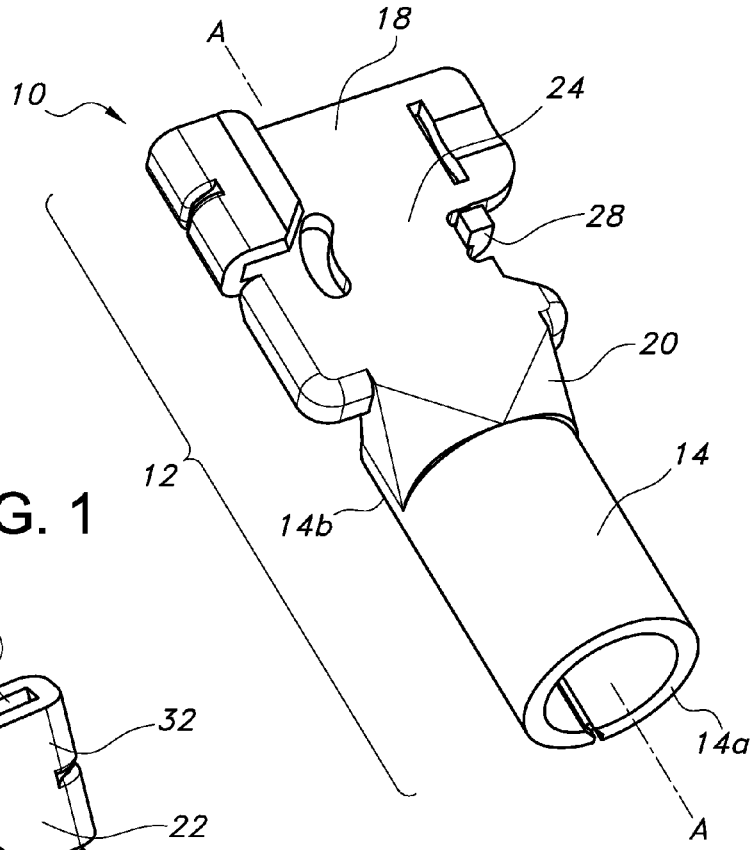
FIGS. 1 and 2 are front and rear perspective views, respectively, of the electrical connector of the present invention.
Figure 2:
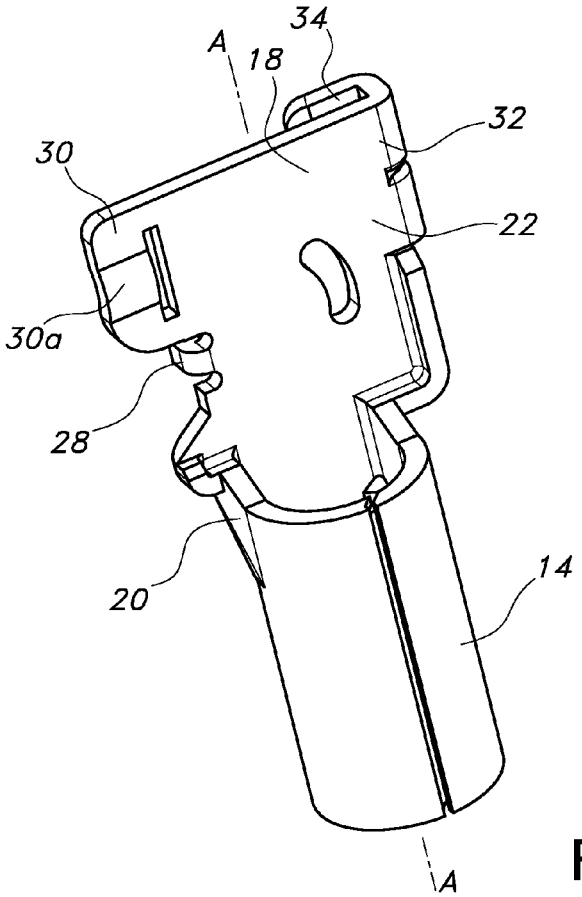
Figure 4:
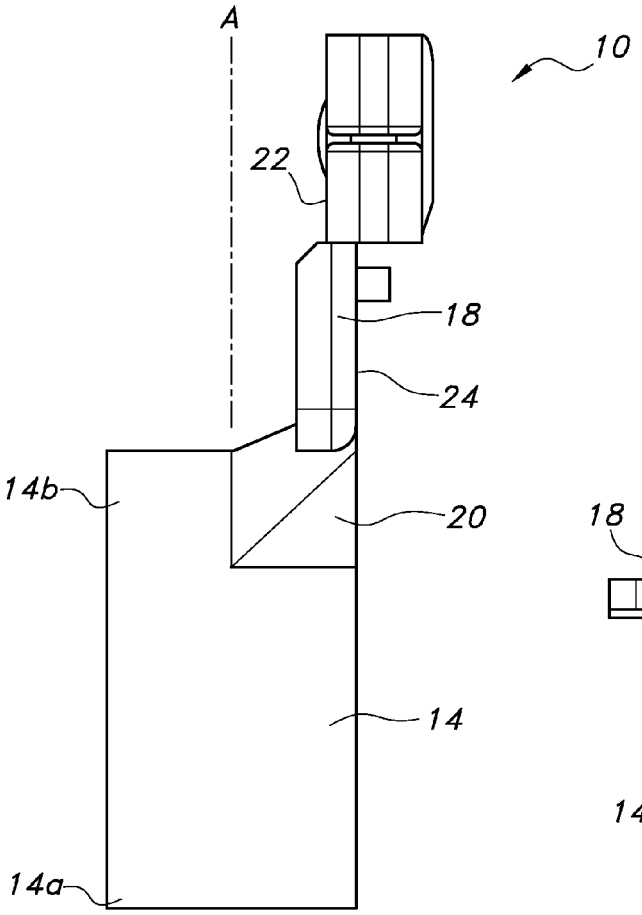
FIG. 4 is an end plan view of the connector of FIGS. 1 and 2.
Figure 4:
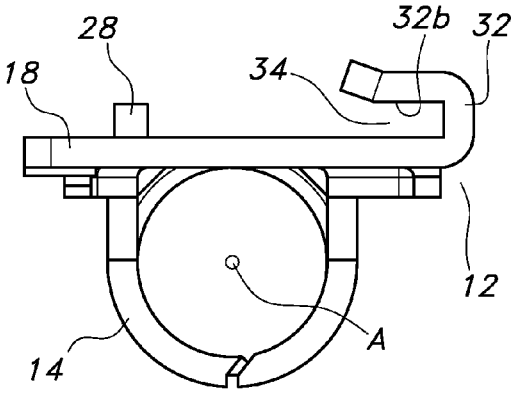
Figure 3:
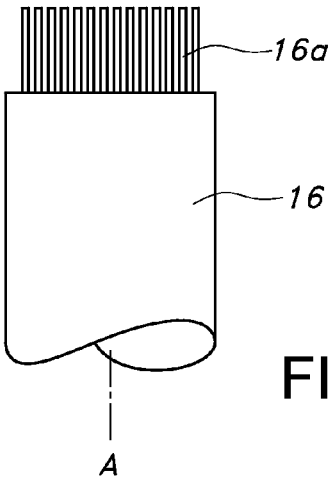
FIG. 3 is a side plan view of the electrical connector of FIGS. 1 and 2 including an electrical conductor for termination therewith.

Referring now to FIGS. 1-4, one embodiment of the hermaphroditic electrical connector of the present invention is shown. Connector 10 is designed to terminate an electrical conductor 16 (FIG. 3).

Connector 10 includes an elongate connector body 12 generally extending along axis A. Connector body 12 may preferably be stamped from sheet metal so that the connector is of integral configuration. As is well known in the connector art, connector body 12 may be formed from any suitable electrically conductive material, preferably copper. The connector body 12 includes at one end an elongate barrel portion 14 which is configured to accommodate therein, in crimped connection, the stripped end 16*a* of insulated conductor 16 (FIG. 3). Barrel 14 includes a conductor insertion end 14*a* and an opposed end 14*b*.

The other end of connector body 12 includes a connection portion 18. Intermediate connection portion 18 is a transition portion 20. As particularly shown in FIG. 3, transition portion 20 provides for axially offsetting the connection portion 18 from barrel portion 14.

Connection portion 18 is generally in the configuration of a flat blade having a first surface 22 facing towards axis A and an opposed second surface 24 facing opposite thereto.

As particularly shown in FIGS. 1 and 2, connection portion 18 includes an aperture 26 extending therethrough between opposed surfaces 22 and 24. Aperture 26 is an elongate aperture which is generally arcuate in configuration.

Adjacent to and extending from connection portion 18 is a projection 28. Projection 28 is bent from the generally planar connection portion 18 in the direction of surface 24 so that it extends therefrom. As will be described in further detail hereinbelow, a dimension of projection 28 permits the projection to be accommodated within aperture 26.

Distal end of connection portion 18 further includes a transversely extending tab 30. Tab 30 extends transversely to the direction of axis A and to the direction of the extending projection 28. Connection portion 18 further includes at its upper end a transversely extending hook 32 which extends in a direction opposite that of tab 30. Hook 32 is formed by bending an extending segment of the connection portion 18 into a generally U-shaped configuration so as to define a open ended slot 34 therein. The tab 30 is constructed so that it interfits into the slot 34 of hook 32 as will be described hereinbelow.

The connector of the present invention is constructed so that one connector body 12 can be hermaphroditically connected to an identically formed connector body thereby placing the two conductors terminated thereto in electrical connection. Moreover, as will be described in further detail hereinbelow, the connection between the hermaphroditic connectors is a disconnectable connection.

Figure 5:
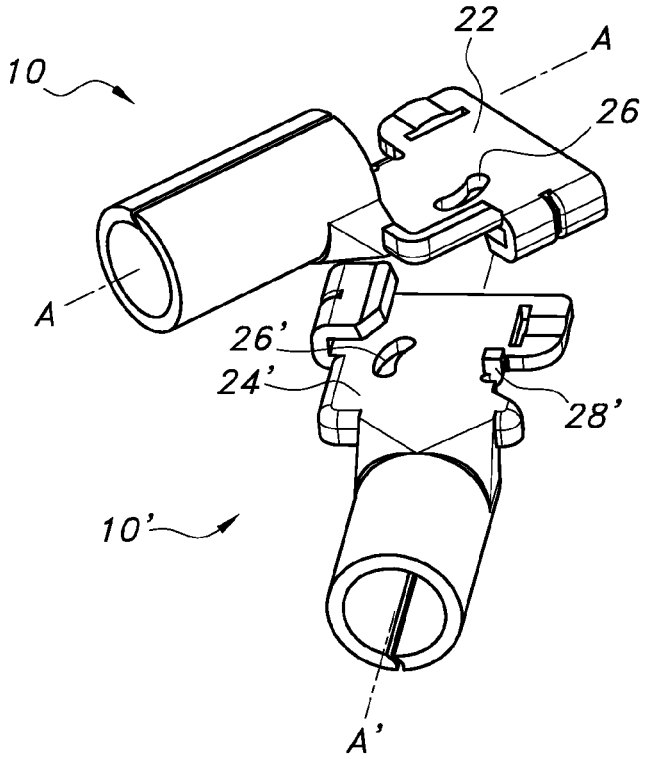
FIGS. 5-7 show, in perspective, successive steps of interconnecting two identically formed electrical connectors of the present invention.
Figure 6:
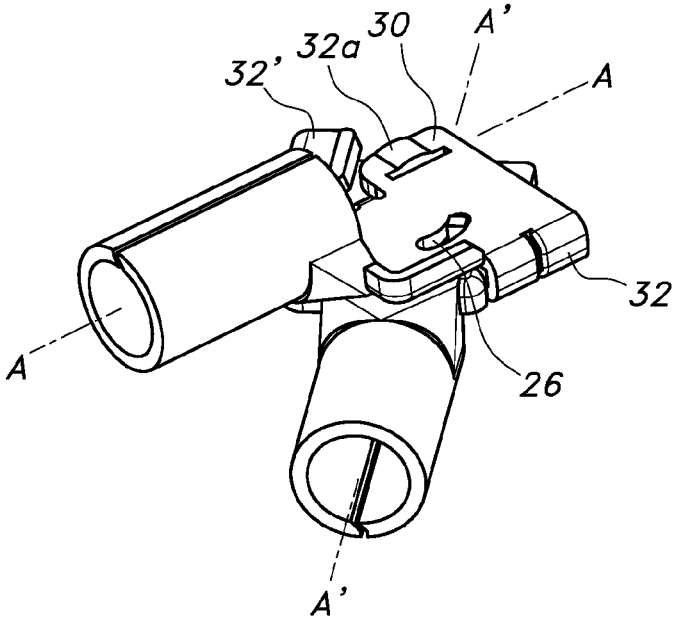

Referring now to FIGS. 5-6, the disconnectable connection of two hermaphroditic connectors of the present invention may be described. FIG. 5 shows a pair of identically formed electrical connectors 10 and 10' of the present invention. Similar reference numerals will be used to denote identical components on each of the connectors. For clarity, the connectors 10 and 10' are shown without termination of conductor 16 (FIG. 3) thereto.

Connectors 10 and 10' are identically formed electrical connectors as described above. In order to effect connection of connector 10 to connector 10', the connectors are positioned adjacent one another as shown in FIG. 5 with axes A and A' being rotationally offset. Connector 10' is coupled to connector 10 by placing surfaces 24 and 24' against one another. The axial offsetting of the connection portion from the barrel portion by the transition portion helps provide such face-to-face contact. The respective connectors 10 and 10' are positioned such that projection 28' of connector 10' is inserted into aperture 26 of connector 10. Similarly, projection 28 of connector 10 will be simultaneously inserted into aperture 26' of connector 10'.

Figure 7:
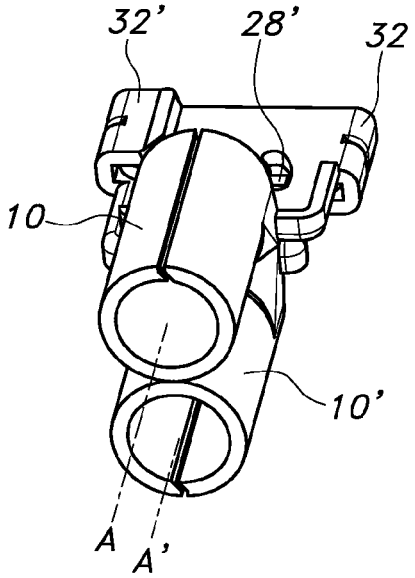

With the surfaces 24 and 24' in planar engagement, as shown in FIG. 6, the connectors 10 and 10' may be mutually rotated to place the axes A and A' in parallel alignment, as shown in FIG. 7. The curved or arcuate configuration of apertures 26 and 26' of each of connectors 10 and 10' allow the connectors to be mutually rotatable with the projections 28, 28' of each in the apertures 26, 26'. The rotational alignment of the connectors 10 and 10' is assisted by the arcuate configuration of apertures 26, 26'. Upon such relative rotation or twisting of the connectors 10 and 10', tab 30 is inserted into the slot 34' of hook 32' of connector 10'. Similarly and simultaneously, the tab 30' of connector 10' is inserted into the slot 34 of hook 32 of connector 10.

As particularly shown in FIG. 2, tab 30 (as well as tab 30') may include an extending cam 30*a*. The extending cam 30*a* bears against the inner wall 32*b* (FIG. 4) of hook 32 and helps frictionally secure the tab within the slot 34 formed by hook 32 when the connectors 10 and 10' are mutually connected. The cam 30*a* also serves as a spring cam surface bearing against inner wall 32*b*. Upon continued rotation of the two connectors, the cam surface provides a spring bias such that the cam surfaces will urge surfaces 24 and 24' into engagement with each other establishing electrical contact therebetween.

The connection of connector 10 to connector 10' is in the nature of a "twist-lock" connection and electrical connection between connectors 10 and 10' is established by face-to-face engagement of surfaces 24 and 24' as well as the interfitting engagement between the tab and the wall of the mating slot of the hook.

As may be appreciated, disconnection of the connectors 10 and 10' may be accomplished by relatively rotating the connectors in the opposite rotational direction. Each tab is moved out of the mating slot and the connectors may be separated from one another.

Figure 8:
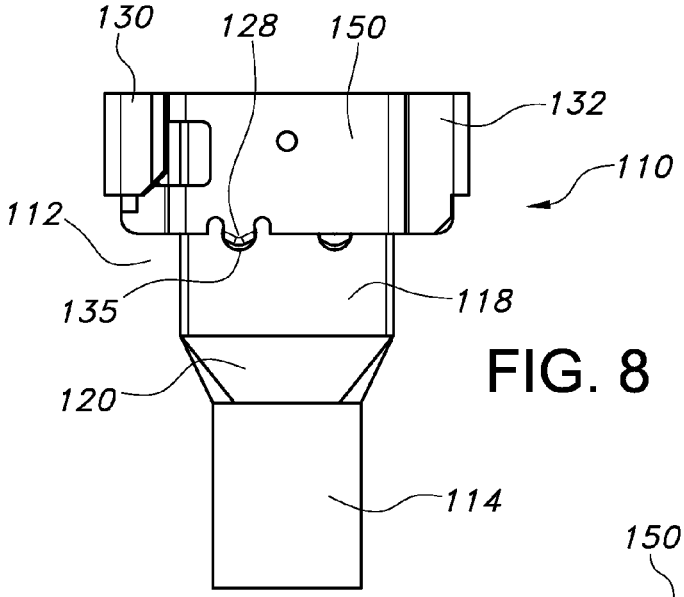
FIG. 8 is a plan view of further embodiment of the electrical connector of the present invention.
Figure 10:
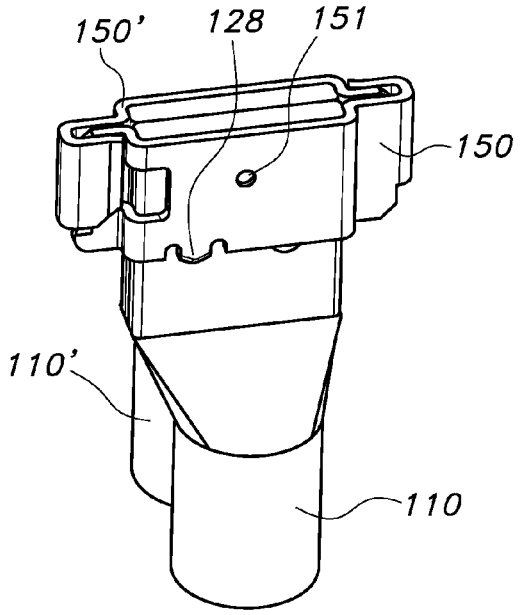
FIGS. 9 and 10 show the interconnection of two identically formed electrical connectors of FIG. 8.
Figure 9:
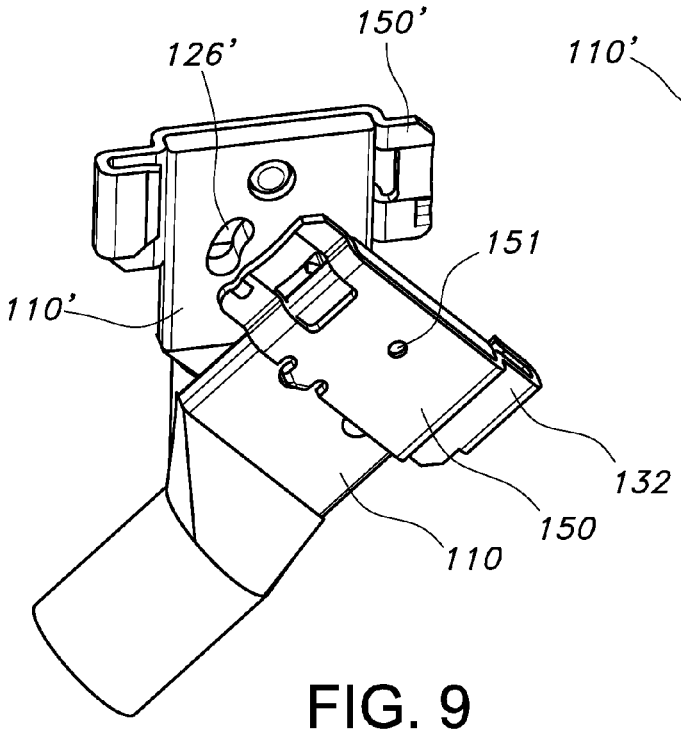

Referring to FIGS. 8-10, a further embodiment of the hermaphroditic connector of the present invention is shown Like reference numerals will be used to describe like components.

Connector 110 includes an elongate connector body 112 having a barrel portion 114, a connection portion 118 and a transition portion 120 therebetween. Connection portion 118 includes aperture 126. Connector body 112 is substantially similar to connector body 12 described above with the following exceptions. Projection 128, as well as tab 130 and hook 132 are formed, not integrally with connector body 112, but are provided on a separate insert 150.

Insert 150, which is preferably formed of stainless steel, is secured at the upper end of connection portion 118 by a rivet 151 or other connection technique such as, for example, welding. In the present illustrative embodiment, the insert is formed of a material different from the material forming the connector body 112.

Use of stainless steel, for example, provides an insert which is stronger than copper. This helps assure that the facing engagement surfaces 124 and 124' are urged together as described above where cam 130*a* acts as a spring cam surface. The stronger steel material acts as a more effective spring. This helps provide good electrical connection between the surfaces 124 and 124' of the connectors.

In the present embodiment, the connection portion 118 includes an opening 135 which allows passage of projection 128 therethrough. Thus, the projection extends through the planar surfaces of the connection portion so that it may be inserted into an aperture 126' of a similarly formed connector body 112' (FIG. 9). In all other respects, the connector of the embodiment shown in FIGS. 8-10 operates in a manner similar to that described above in providing disconnectable twist lock connection between connector body 112 and connector body 112'.

Various changes to the foregoing described and shown structures would now be evident to those skilled in the art. Accordingly, the particularly disclosed scope of the invention is set forth in the following claims.

What is claimed is:

1. An electrical connector assembly comprising:

a pair of identical hermaphroditic electrical connectors, each said connector having:

an elongate barrel portion for accommodating one end of an electrical conductor;

a transition portion extending from said barrel portion;

a connection portion extending from said transition portion;

a tab extending transversely outward from the connection portion in a first direction; and a hook, the hook having a first wall extending transversely outward from the connection portion in a second direction opposite said first direction, the hook having a U-shaped portion attached to the first wall, the hook having a second wall extending transversely from the U-shaped portion in said first direction;

said connectors being adapted for disconnectable electrical coupling such that the tab of one connector of said pair is adapted to be insertably received in the hook of the other connector of said pair while the tab of the other said connector is adapted to be insertably received in the hook of said one connector.

2. The electrical connector assembly of claim 1 wherein each said tab includes a cam surface and said cam surface of said one connector provides a spring biased bearing engagement against a wall of said hook of said other connector while said cam surface of said other connector provides a spring biased bearing engagement against a wall of said hook of said one connector.

3. The connector assembly of claim 1 wherein each said barrel portion has a central axis and wherein said connection portion is axially offset from said central axis by said transition portion.

4. The connector assembly of claim 1 wherein said connector is integrally formed.

5. The electrical connector assembly of claim 1 further comprising:

said second wall being generally parallel to and spaced apart from said first wall, wherein the hook forms an open ended slot facing in said first direction; and said connectors being adapted for disconnectable electrical coupling such that the tab of one connector of said pair is adapted to be insertably received in the open ended slot of the other connector of said pair while the tab of the other said connector is adapted to be insertably received in the open ended slot of said one connector.

6. The electrical connector assembly of claim 1 wherein each said connector portion further includes an elongate aperture therethrough and an extending projection adjacent said aperture, and wherein upon said coupling of said connectors said extending projection of said one connector is inserted into said aperture of said other connector while said extending projection of said other connector is inserted into said aperture of said one connector.

7. The connector assembly of claim 6 wherein each said aperture is arcuate in shape.

8. The connector assembly of claim 1 further including an insert attached to said connection portion, said insert including said tab and said hook.

9. The connector assembly of claim 8 wherein each said insert further includes said projection.

10. The connector assembly of claim 9 wherein each said connection portion includes an opening for insertion of said projection of said insert therethrough.

11. The connector assembly of claim 8 wherein said connector is formed of a first material and said insert is formed of a second material different from said first material.

12. The connector assembly of claim 11 wherein said second material is higher in strength than said first material.

13. The connector assembly of claim 12 wherein said connector is formed from copper and said inert is formed from steel.

14. An electrical connector assembly comprising:

a pair of identical hermaphroditic electrical connectors, each said connector including:

an elongate barrel portion for accommodating one end of an electrical conductor;

a transition portion extending from said barrel portion;

a connection portion extending from said transition portion;

a tab extending transversely outward from the connection portion in a first direction;

a hook, the hook having a first wall extending transversely outward from the connection portion in a second direction opposite said first direction, the hook having a U-shaped portion attached to the first wall, the hook having a second wall spaced apart from said first wall, said second wall extending transversely from the U-shaped portion in said first direction, the hook having an open ended slot facing in said first direction;

an elongate arcuate aperture therethrough; and an extending projection adjacent said aperture;

said connectors being adapted for disconnectable electrical coupling such that the tab of one connector of said pair is adapted to be insertably received in the slot of the other connector of said pair while the tab of the other said connector is adapted to be insertably received in the slot of said one connector, and said extending projection of said one connector is adapted to be inserted into said aperture of said other connector while said extending projection of said other connector is adapted to be inserted into said aperture of said one connector, so as to align said connectors during assembly.

15. The electrical connector assembly of claim 14 wherein each said tab includes a cam surface and said cam surface of said one connector provides a spring biased bearing engagement against a wall of said hook of said other connector while said cam surface of said other connector provides a spring biased bearing engagement against a wall of said hook of said one connector.

16. The connector assembly of claim 14 wherein each said barrel portion has a central axis and wherein said connection portion is axially offset from said central axis by said transition portion.

17. The connector assembly of claim 14 wherein said connector is integrally formed.

* * * * *